US009651050B2

(12) United States Patent
Burman

(10) Patent No.: US 9,651,050 B2
(45) Date of Patent: May 16, 2017

(54) PROPELLER PUMP AND PUMP STATION

(71) Applicant: XYLEM IP HOLDINGS LLC, White Plains, NY (US)

(72) Inventor: Jörgen Burman, Järfälla (SE)

(73) Assignee: XYLEM IP HOLDINGS LLC, White Plains, NY (US)

( * ) Notice: Subject to any disclaimer, the term of this patent is extended or adjusted under 35 U.S.C. 154(b) by 397 days.

(21) Appl. No.: 14/365,126

(22) PCT Filed: Dec. 13, 2012

(86) PCT No.: PCT/US2012/069373

§ 371 (c)(1),
(2) Date: Jun. 13, 2014

(87) PCT Pub. No.: WO2013/090500

PCT Pub. Date: Jun. 20, 2013

(65) Prior Publication Data

US 2014/0363273 A1 Dec. 11, 2014

(30) Foreign Application Priority Data

Dec. 13, 2011 (SE) ..... 1151185

(51) Int. Cl.
*F04D 29/54* (2006.01)
*F04D 3/00* (2006.01)
(Continued)

(52) U.S. Cl.
CPC ..... *F04D 3/00* (2013.01); *F04D 3/02* (2013.01); *F04D 29/528* (2013.01); *F04D 29/548* (2013.01)

(58) Field of Classification Search
CPC ... F04D 3/00; F04D 3/005; F04D 3/02; F04D 29/528; F04D 29/548
See application file for complete search history.

(56) References Cited

U.S. PATENT DOCUMENTS 1,971,386 A * 8/1934 Schmidt ..... F04D 3/005 415/201
3,910,728 A * 10/1975 Sloan ..... F04D 13/046 417/390
(Continued)

FOREIGN PATENT DOCUMENTS

AU 524892 B2 10/1982
DE 572787 C 3/1933
(Continued)

OTHER PUBLICATIONS

International Search Report: PCT/US2012/069373, European Patent Office, Sep. 20, 2013.

*Primary Examiner* — Richard Edgar
(74) *Attorney, Agent, or Firm* — Browdy and Neimark, PLLC

(57) ABSTRACT

A propeller pump includes a pump housing and a pump core that is arranged in the pump housing and has a propeller, which together delimit a channel, and which are connected by a guide vane. The channel (27) haws a cross-sectional area (A2) at the rear edge (30) of the guide vane (13) that is greater than a cross-sectional area ($A_1$) at the rear edge (29) of the blades (21) of the propeller. The specific rotational speed of the propeller pump is greater than 200 and less than 300.

11 Claims, 5 Drawing Sheets

(51) Int. Cl.
*F04D 3/02* (2006.01)
*F04D 29/52* (2006.01)

(56) References Cited

U.S. PATENT DOCUMENTS

| | | | |
|---|---|---|---|
| 3,957,402 | A | 5/1976 | Sloan |
| 5,221,182 | A | 6/1993 | Arbeus |

FOREIGN PATENT DOCUMENTS

| | | | |
|---|---|---|---|
| DE | 2310063 | B1 | 9/1973 |
| DE | 4433066 | A1 | 3/1996 |
| EP | 0475920 | A1 | 3/1992 |
| GB | 368160 | A | 3/1932 |
| GB | 581444 | A | 10/1946 |
| GB | 819248 | A | 9/1959 |
| WO | 2007147380 | A1 | 12/2007 |

* cited by examiner

PROPELLER PUMP AND PUMP STATION

TECHNICAL FIELD OF THE INVENTION

The present invention relates generally to a propeller pump, also known under the denomination axial pump, for the pumping of liquid. A propeller pump is normally used to transport great liquid flows with a relatively low pressure. In particular, the present invention relates to a propeller pump comprising an axially extending tubular pump housing, which has an inner surface and which comprises an inlet opening and an outlet opening. The propeller pump also comprises an axially extending pump core having an envelope surface, at least an axial part section of the pump core being surrounded by said pump housing. In addition, the propeller pump comprises at least one radially extending guide vane, which is connected to the inner surface of the pump housing and the envelope surface of the pump core. The pump core comprises in turn a drive unit and a hydraulic unit that is situated upstream in relation to the drive unit and comprises a propeller having a hub and at least one blade. The propeller pump also comprises an axially extending channel, which extends from the inlet opening of the pump housing to the outlet opening of the pump housing, which channel, in the radial direction, is delimited by the inner surface of the pump housing and the envelope surface of the pump core, respectively.

In a second aspect, the present invention relates to a pump station comprising such a propeller pump as well as a column pipe, the propeller pump being arranged in the lower end of the column pipe.

BACKGROUND OF THE INVENTION AND PRIOR ART

Prior art propeller pumps have been designed according to a hypothesis that is recognized within the technical field of propeller pumps and, among other things, is based on the following. Propeller pumps are designed in such a way that the cross-sectional area of the channel of the propeller pump should, within an as short as possible axial distance, increase from the cross-sectional area ($A_1$) found in the region of the rear edge of the blades of the propeller to as large as possible cross-sectional area ($A_2$) in the region of the rear edge of the guide vanes, and after that increase further to a larger cross-sectional area ($A_3$) in the region of the outlet opening of the channel. This is for minimizing the losses and having as large as possible pressure regain. However, the possibility of minimizing the axial distance is limited by the fact that separation (regions with rearwardly directed flows) arises at too steep increase of the cross-sectional area. The emergence of separation means that the losses increase considerably. In prior art propeller pumps, the knowledge of what degree of cross-sectional area increase is possible without separation arising has been based on inviscous calculations wherein the designers have relied on empirical, so-called diffusion factors to determine whether separation arises in the guide vane passage. These factors were developed by cascade tests in the 1950's. As for the diffuser after the rear edge of the guide vanes to the outlet opening of the channel, one has been reduced to so-called performance charts for annular diffusers.

Below, examples of recognized area relationships according to the above-mentioned hypothesis follow: [$A_2 \approx 1.4 * A_1$] and [$A_3 \approx 2.3 * A_1$]. These area relationships are valid for propeller pumps having relatively high specific rotational speeds ($n_q$), for instance within the range of 200-300, which is a measure of how great liquid flow Q can be transported to a certain pressure head H of a propeller pump operating at a nominal rotational speed n, wherein [$n_q = n * Q^{(1/2)} / H^{(3/4)}$]. As a consequence of the fast area increase, such a design involves that a lower flow rate is obtained in the fastest possible manner, and a direct consequence of this has, according to the hypothesis, been considered to be that the losses that arise in the region downstream the upper end of the propeller pump will be minimized.

Propeller pumps designed according to the above-mentioned hypothesis have, however, in a quite opposite way turned out to create large losses and large regions of separation in the channel in the region of the guide vanes and/or in the diffuser downstream the rear edge of the guide vanes and/or in the column pipe downstream the propeller pump. This depends on the diffusion factors being based on two-dimensional experiments that do not take into account e.g., secondary flow and the curvature of the channel. Also the performance charts for diffusers have limitations, as for instance that they presuppose so-called linear end walls (the envelope surface of the pump core and the inner surface of the pump housing) and a uniform flow rate profile into the diffuser, i.e., a uniform flow rate profile along the cross-sectional area taken in the region of the rear edge of the guide vanes.

BRIEF ACCOUNT OF THE OBJECTS OF THE INVENTION

The present invention aims at obviating the above-mentioned disadvantages and failings of prior art propeller pumps and at providing an improved propeller pump.

A primary object of the invention is to provide an improved propeller pump of the type defined by way of introduction, which provides a uniform flow rate profile at the cross-sectional area taken in the region of the rear edge of the guide vanes and/or in the region of the outlet opening of the channel.

Another object of the present invention is to provide a propeller pump that needs a, relatively speaking, narrower column pipe.

BRIEF DESCRIPTION OF THE FEATURES OF THE INVENTION

According to the invention, at least the primary object is achieved by means of the propeller pump and the pump station defined by way of introduction and having the features defined in the independent claims. Preferred embodiments of the present invention are furthermore defined in the depending claims.

According to a first aspect of the present invention, a propeller pump of the type defined by way of introduction is provided, which is characterized in that a cross-sectional area ($A_2$) of said channel in the region of a rear edge of said at least one guide vane is greater than a factor of 1.04 times a cross-sectional area ($A_1$) of the channel in the region of a rear edge of the at least one blade of the propeller, in that the cross-sectional area ($A_2$) of said channel, in the region of the rear edge of said at least one guide vane, is less than or equal to a factor of 1.1 times the cross-sectional area ($A_1$) of said channel in the region of the rear edge of the at least one blade of the propeller, in that a cross-sectional area ($A_3$) of said channel, in the region of the outlet opening of the pump housing, is larger than or equal to the cross-sectional area ($A_2$) of the channel in the region of the rear edge of said at least one guide vane, in that the cross-sectional area ($A_3$) of said channel, in the region of the outlet opening of the pump housing, is less than or equal to a factor of 1.9 times the cross-sectional area ($A_1$) of said channel in the region of the rear edge of the at least one blade of the propeller, and in that the propeller pump has a specific rotational speed ($n_q$) that is greater than or equal to 200 and that is less than or equal to 300.

According to a second aspect of the present invention, there is provided a pump station comprising such a propeller pump.

Thus, the present invention is based on the understanding that, for a certain group of propeller pumps having a specific rotational speed falling within the interval of 200-300, by a controlled modest increase of the cross-sectional area of the channel of the pump housing between a position situated at the region of the rear edge of the blades of the propeller and a position situated at the region of the rear edge of the guide vanes and at the outlet opening of the channel, respectively, a controlled flow rate profile is obtained along the cross-sectional area taken in the region of the rear edge of the guide vanes and/or the outlet opening of the channel, without the presence of a rearwardly directed flow.

According to the present invention, a cross-sectional area ($A_3$) of said channel, in the region of the outlet opening of the pump housing, is larger than or equal to a cross-sectional area ($A_2$) of the channel in the region of a rear edge of said at least one guide vane, and the cross-sectional area ($A_3$) of said channel, in the region of the outlet opening of the pump housing, is less than or equal to a factor of 1.9 times the cross-sectional area ($A_1$) of said channel in the region of the rear edge of the at least one blade of the propeller. This entails that, by a controlled modest increase of the cross-sectional area of the channel of the pump housing between a position situated at the region of the rear edge of the guide vane and a position situated at the region of the outlet opening of the channel, a uniform flow rate profile is obtained along the cross-sectional area taken in the region of the outlet opening of the channel, which gives fewer losses downstream the propeller pump.

According to a preferred embodiment, the pump core comprises furthermore a sealing unit, which in turn comprises an axially extending tubular oil housing and said at least one guide vane, which sealing unit is arranged surrounded by said pump housing, said at least one guide vane being fixedly connected with an inner surface of the pump housing and an envelope surface of the oil housing. This entails a robust design of a supporting unit of the propeller pump, wherein the hydraulic unit and the drive unit can be readily connected to the supporting unit.

Additional advantages and features of the invention are seen in the other dependent claims as well as in the following, detailed description of preferred embodiments.

BRIEF DESCRIPTION OF THE DRAWINGS

A more complete understanding of the above-mentioned and other features and advantages of the present invention will be clear from the following, detailed description of preferred embodiments, reference being made to the accompanying drawings, wherein.

DETAILED DESCRIPTION OF PREFERRED EMBODIMENTS

Figure 1:
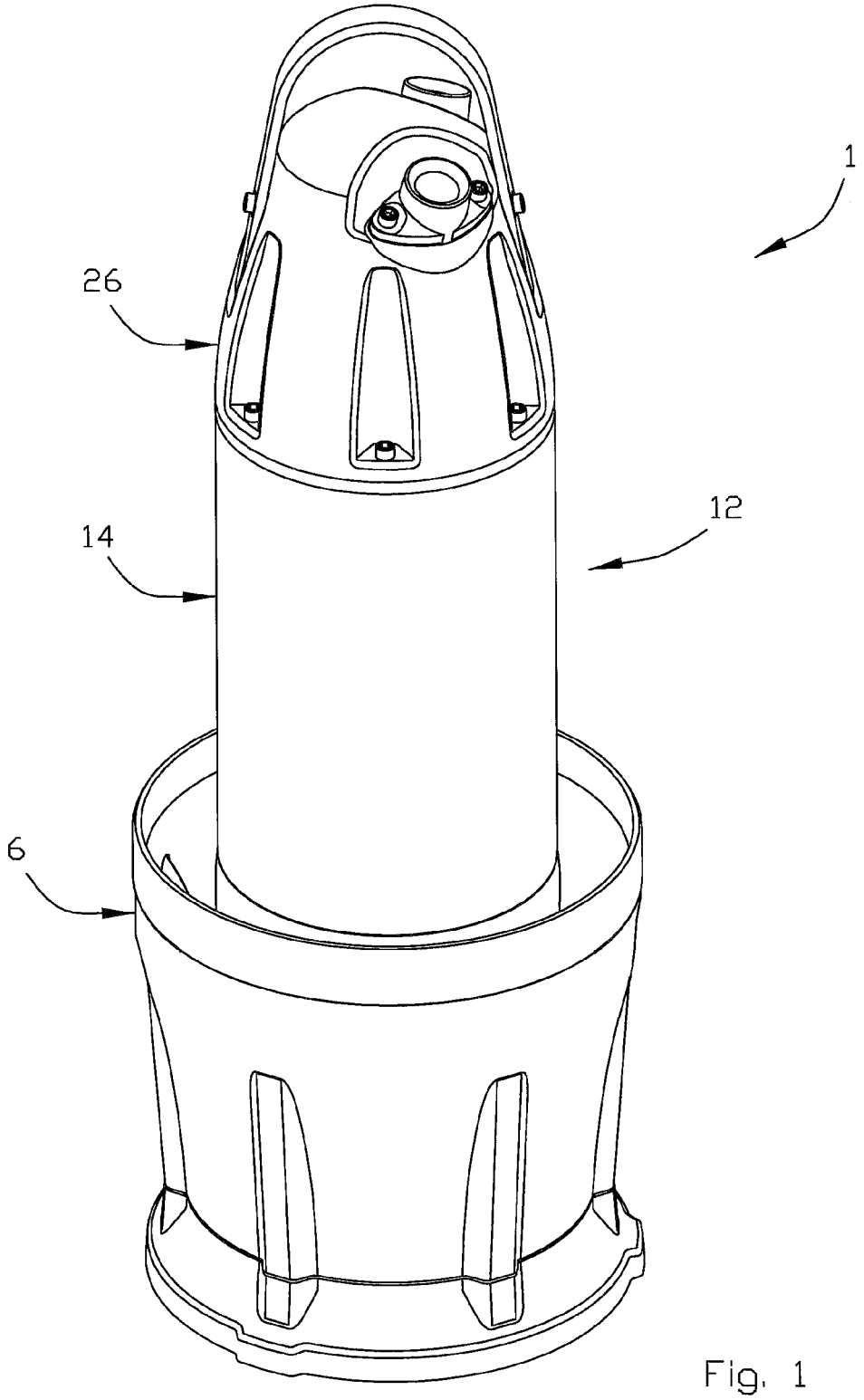
FIG. 1 is a perspective view from above of a propeller pump according to the invention.
Figure 2:
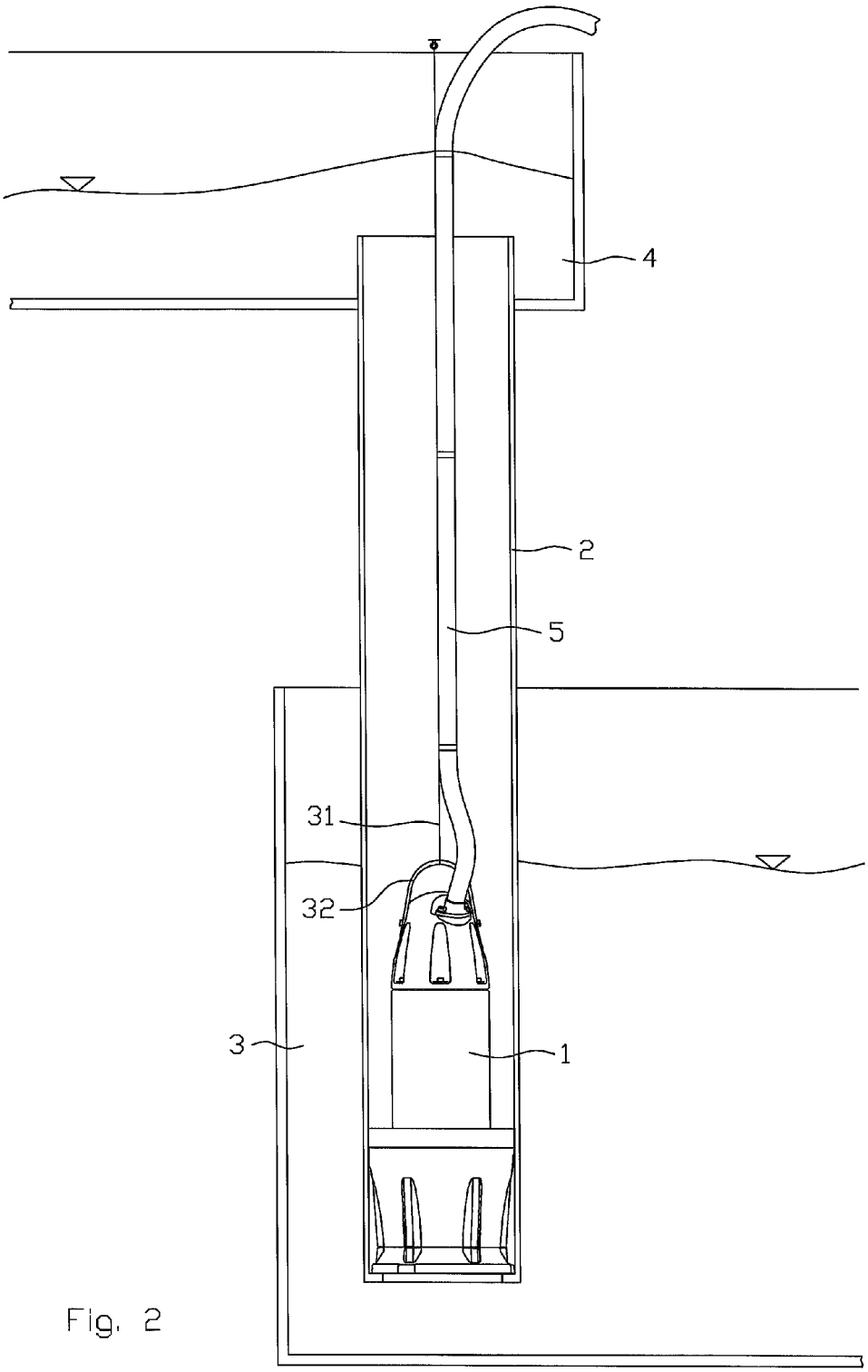
FIG. 2 is a schematic cross sectional side view of a pump station according to the invention comprising a propeller pump according to FIG. 1.

Reference is initially made to FIGS. 1 and 2. The present invention relates generally to a propeller pump, or axial pump, generally designated 1, for the pumping/transportation of liquid such as water, surface water, waste water, etc. Propeller pumps are generally arranged to transport great liquid flows with a relatively low pressure. Furthermore, a propeller pump according to the present invention is designed to have a specific rotational speed ($n_q$) that is greater than or equal to 200, and that is less than or equal to 300. The specific rotational speed is determined as [$n_q = n*Q^{(1/2)}/H^{(3/4)}$], wherein n=the nominal rotational speed of the propeller pump, Q=the pumped liquid flow, and H=the pressure head of the pumped liquid.

In FIG. 1, a perspective view of a propeller pump 1 according to the invention is shown, and in FIG. 2, there is shown a part of a schematic pump station that comprises one or more propeller pumps 1, each propeller pump 1 being arranged at a lower end of a column pipe 2 extending from a lower basin 3 to an upper basin 4, with the purpose of transporting liquid from the lower basin 3 to the upper basin 4. It should be pointed out that the axial length of the column pipe 2 usually is several times greater than the axial height of the propeller pump 1, and that the propeller pump 1 and the column pipe 2 are concentrically arranged in relation to each other. The propeller pump 1 is connected to one or more cables 5 for the power supply and possible signal transfer, which cables 5 run from the propeller pump 1 up, via the inside of the column pipe 2, to a source of power and/or a control unit (not shown).

Figure 3:
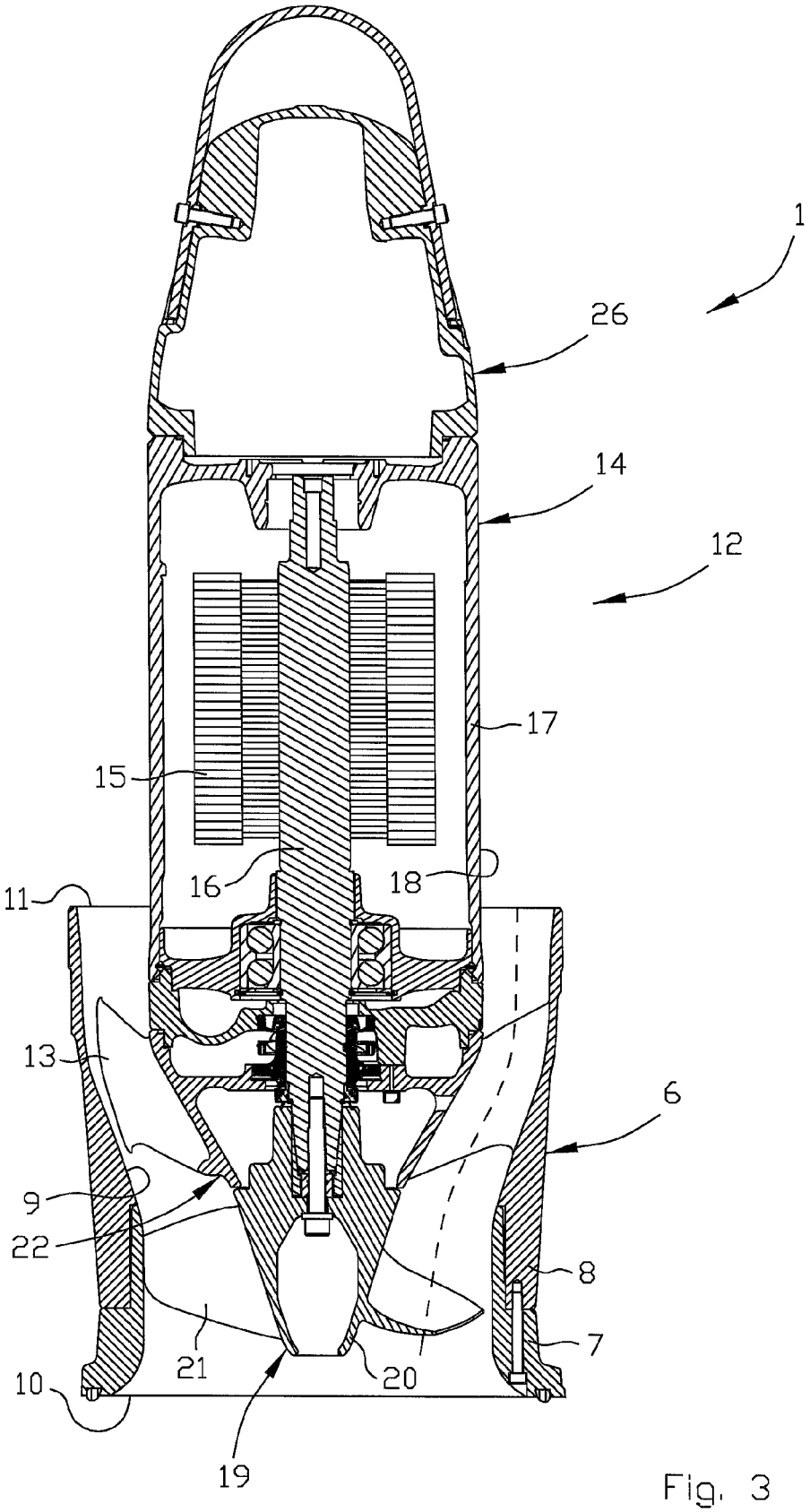
FIG. 3 is a cross sectional side view of the propeller pump according to FIG. 1.
Figure 4:
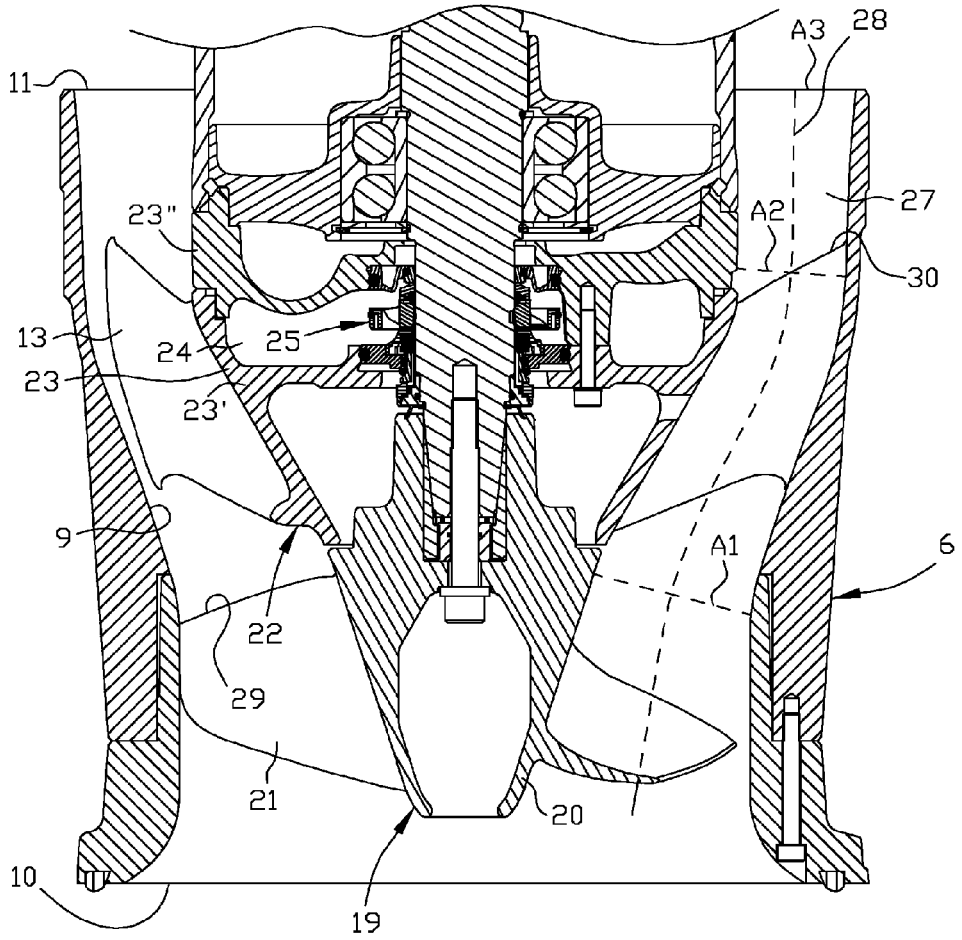
FIG. 4 is an enlargement of a part of FIG. 3.

Reference is now also made to FIGS. 3 and 4. In FIG. 3, a cross sectional side view of such a propeller pump 1 is shown, and in FIG. 4, there is shown an enlarged part of the propeller pump shown in FIG. 3.

The inventive propeller pump 1 comprises an axially extending tubular pump housing, generally designated 6, which comprises an inlet funnel 7 and a diffuser 8, which are interconnected in an axial interrelationship. In the embodiment shown, the inlet funnel 7 and the diffuser 8 are telescopically arranged and detachably connected by means of axially extending screws. The pump housing 6 has an inner surface 9 and comprises furthermore an inlet opening 10 situated in the region of the lower end of the inlet funnel 7 and an outlet opening 11 situated in the region of the upper end of the diffuser 8. The propeller pump 1 is arranged to be lowered down into the column pipe 2, and has thereby a somewhat smaller outer diameter than an inner diameter of the column pipe 2. Thereby, a gap arises between an external surface of an upper end of the diffuser 8 and an inner surface of the column pipe 2. In order to prevent reflux of the pumped liquid down through said gap, via the space situated between the inner surface of the column pipe 2 and an outer surface of the pump housing 6 and further to the inlet opening 10, the pump housing 6 rests on and closes tightly against a radially inwardly extending flange arranged in the lower end of the column pipe 2.

Figure 5:
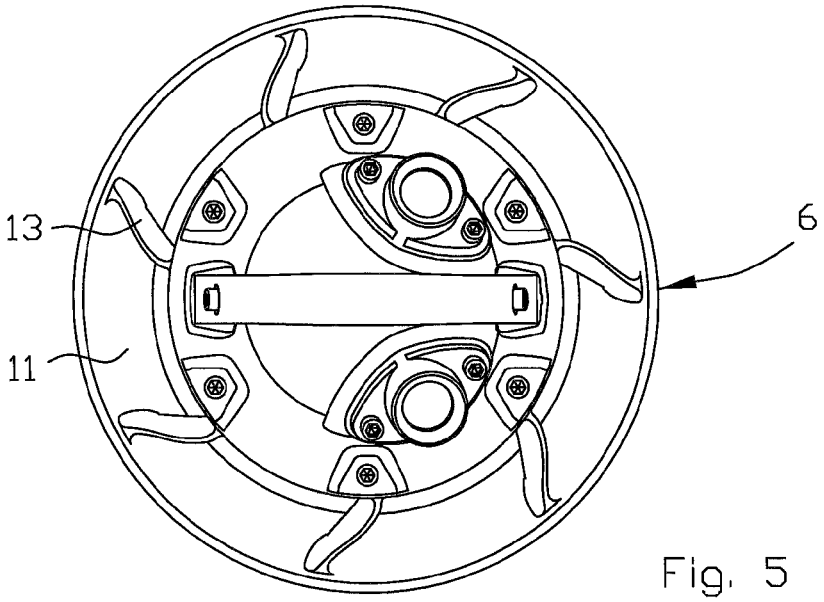
FIG. 5 is a view from above of the propeller pump according to FIG. 1.

Furthermore, the propeller pump 1 according to the invention comprises an axially extending pump core, generally designated 12, having an outer envelope surface that, in the radial direction, is situated at a distance from the inner surface of the column pipe 2, when the propeller pump 1 is in the mounted state in the column pipe 2. Preferably, the pump core 12 has an axial height that is greater than the axial height of the pump housing 6, wherein at least an axial part section of the pump core 12 should be surrounded by said pump housing 6. Preferably, the axial height of the pump core 12 is at least twice as large as the axial height of the pump housing 6. In other words, the pump housing 6 and the pump core 12 are arranged overlapping each other in the axial direction, at the same time as the pump core 12, in the radial direction, is situated at a distance from the inner surface 9 of the pump housing 6. Preferably, the pump core 12 and the pump housing 6 are concentrically arranged in relation to each other. In addition, the propeller pump 1 according to the invention comprises at least one radially extending guide vane 13, which is connected to the inner surface 9 of the pump housing 6 and the envelope surface of the pump core 12. Preferably, the propeller pump 1 comprises five or seven such guide vanes 13, which are equidistantly arranged along the circumference of the pump core 12. Refer also to FIG. 5, which shows a planar view from above of a propeller pump according to the invention.

The pump core 12 comprises a drive unit, generally designated 14, which comprises an electric motor 15 and a drive shaft 16 extending from said motor, the motor 15 being directly or indirectly connected to the power supply cable 5. Preferably, the drive unit 14 comprises an axially extending tubular motor housing 17 having an envelope surface 18.

Figure 6:
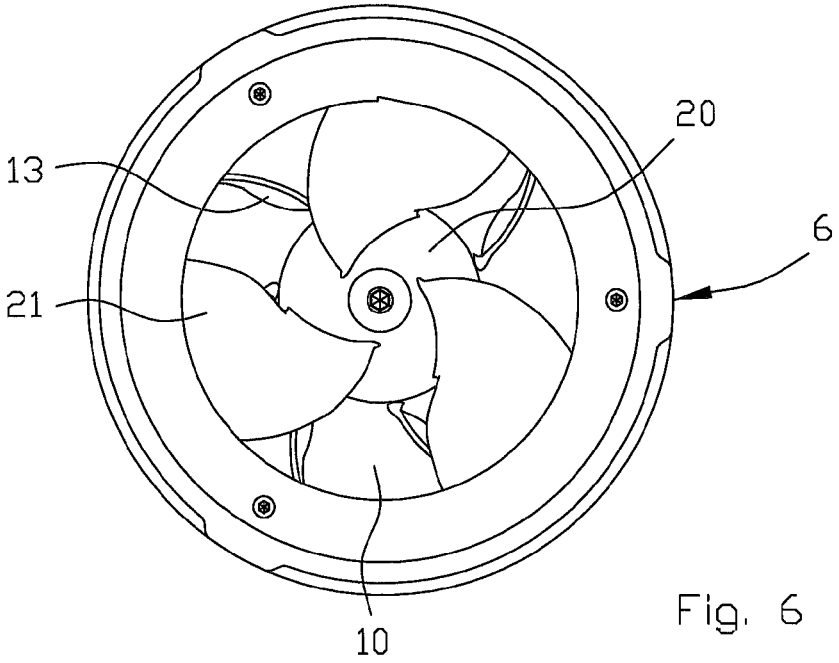
FIG. 6 is a view from below of the propeller pump according to FIG. 1.

Furthermore, the pump core 12 comprises a hydraulic unit, generally designated 19, which comprises a propeller having a hub 20 and at least one blade 21 that is connected to and projects in the radial direction from said hub 20. Said at least one blade 21 extends toward the inner surface 9 of the pump housing 6, and a narrow gap separates said at least one blade 21 and the inner surface 9 of the pump housing 6. The hub 20 of the propeller is detachably connected with and driven in rotation by the drive shaft 16, by being, in the shown embodiment example, fastened by means of a screw in a free lower end of the drive shaft 16 in a conventional way. The hydraulic unit 19 is entirely surrounded by the pump housing 6, i.e., the entire hydraulic unit 19 is situated between the inlet opening 10 and outlet opening 11 of the pump housing. Preferably, the propeller comprises three or four blades 21, which are equidistantly arranged along the circumference of the hub 20. Refer also to FIG. 6, which shows a planar view from below of a propeller pump according to the invention.

In accordance with the shown embodiment example, preferably, the pump core 12 also comprises a sealing unit, generally designated 22, which is arranged directly downstream the hydraulic unit 19 and directly upstream the drive unit 14. The sealing unit 22 comprises an axially extending tubular oil housing 23 and said at least one guide vane 13, which, in the embodiment shown, is fixedly connected to the inner surface 9 of the pump housing 6 and an envelope surface of the oil housing 23. The sealing unit 22 is, like the hydraulic unit 19, arranged surrounded by the pump housing 6. In the shown embodiment example, the oil housing 23 consists of a first, lower part 23' that is called oil housing bottom and a second, upper part 23" that is called oil housing cover, which together define a chamber 24 accommodating a liquid, preferably an oil. The oil housing 23 forms a seat for a drive shaft sealing assembly, generally designated 25, included in the sealing unit 22. The drive shaft sealing assembly 25, also known as sealing cartridge, comprises an outer mechanical face seal, which prevents the pumped liquid from leaking into the chamber 24 of the oil housing 23, and an inner mechanical face seal, which prevents passage of liquid between the chamber 24 of the oil housing 23 and the drive unit 14. Instead of said mechanical face seals, the drive shaft sealing assembly 25 may comprise other types of suitable seals, and alternatively the sealing unit 22 may comprise another type of sealing solution than said drive shaft sealing assembly. Thus, it should be pointed out that the drive shaft 16 extends through the oil housing 23 and said drive shaft sealing assembly 25, which is arranged in the interfaces between the drive unit 14 and the sealing unit 22, and between the sealing unit 22 and the hydraulic unit 19, respectively.

Furthermore, in the shown embodiment, the pump core 12 comprises a pump top, generally designated 26, in which internal power supply to the motor 15 and external power supply via the power supply cable 5 are interconnected. Preferably, the hydraulic unit 19, the sealing unit 22, the drive unit 14, and the pump top 26 are concentrically arranged in relation to each other. Preferably, the pump top 26 has a truncated conical shape in order to minimize the emergence of regions having a rearwardly directed/negative flow rate in the column pipe 2 directly downstream the pump top 26. Preferably, the pump top 26 has an envelope surface of double curvature with increasing taper in the downstream direction. Furthermore, the height of the pump top 26 should preferably be approximately equal to 0.8-1.1 times the diameter of the base of the pump top 26, and the diameter of the top of the pump top 26 should be approximately equal to 0.4-0.7 times the diameter of the base of the pump top 26.

Among the included parts of the pump core 12, the hydraulic unit 19 is situated farthest upstream, i.e., closest to the inlet opening 10 of the pump housing 6. As viewed in the downstream direction from the inlet opening 10 of the pump housing 6, the hydraulic unit 19 is arranged adjacent to the sealing unit 22, and the propeller of the hydraulic unit 19 is rotatable in relation to the oil housing 23 of the sealing unit 22. The drive unit 14 is in turn arranged adjacent to and connected to the sealing unit 22, after which the pump top 26 is arranged adjacent to and connected to the drive unit 14. The respective interfaces between the pump top 26 and the drive unit 14, between the drive unit 14 and the sealing unit 22, and between the sealing unit 22 and the hydraulic unit 19, are liquidtight to prevent the pumped liquid from entering and damaging the internal parts in the pump core 12, for instance electronics and the motor 15.

The propeller pump 1 according to the invention also comprises an axially extending channel 27 that extends from the inlet opening 10 of the pump housing 6 to the outlet opening 11 of the pump housing 6, which channel 27, in the radial direction, is delimited by the inner surface 9 of the pump housing 6 and the envelope surface of the pump core 12, respectively. In the shown preferred embodiment of the propeller pump 1, in the radial direction, said channel 27 is delimited by the inner surface 9 of the pump housing 6 and an envelope surface of the hub 20 of the propeller, the envelope surface of the oil housing 23, and the envelope surface 18 of the motor housing 17, respectively. It should be pointed out that only one axial part section of the envelope surface 18 of the motor housing 17 assists in delimiting said channel 27, as the major part of the envelope surface 18 of the motor housing 17 is axially separated from the pump housing 6. Preferably, said channel 27 has an annular or toroidal subchannel that, in the axial direction, extends from the part situated farthest upstream of the hub 20 of the propeller to the outlet opening 11 of the pump housing 6. In other words, the toroidal subchannel of the channel 27 is rotationally symmetrical.

Furthermore, said channel 27 has, as viewed in an axially extending plane that intersects a centre line of the propeller pump 1 in accordance with FIGS. 3 and 4, a centre line 28 illustrated by means of a dashed line in FIGS. 3 and 4. Various cross-sectional areas of the channel 27 described herein are taken transversely/perpendicular to said centre line 28 of the channel 27, as a consequence of the inner surface 9 of the pump housing 6 and the envelope surface of the pump core 12 not being parallel to each other along the entire or even along a part of the length of the channel 27. In case a specific cross-sectional area is measured at a point of the centre line 28 of the channel 27, where a tangent to the centre line 28 of the channel 27 is not parallel to the centre line of the propeller pump 1, this specific cross-sectional area will accordingly be equivalent to the area of an envelope surface of a truncated cone.

In the propeller pump 1 according to the invention, at least three central cross-sectional areas can be measured/regarded. These three central cross-sectional areas are: a cross-sectional area ($A_1$) of said channel 27 taken in the region of a rear edge 29 of the at least one blade 21 of the propeller, a cross-sectional area ($A_2$) of said channel 27 taken in the region of a rear edge 30 of said at least one guide vane 13, as well as a cross-sectional area ($A_3$) of said channel 27 taken in the region of the outlet opening 11 of the pump housing 6.

According to the present invention, the cross-sectional area ($A_2$) of said channel 27, in the region of the rear edge 30 of said at least one guide vane 13, should be larger than or equal to the cross-sectional area ($A_1$) of the channel 7 in the region of the rear edge 29 of the at least one blade 21 of the propeller, and furthermore, the cross-sectional area ($A_2$) of said channel 27, in the region of the rear edge 30 of said at least one guide vane 13, should be less than or equal to a factor of 1.1 times the cross-sectional area ($A_1$) of said channel 27 in the region of the rear edge 29 of the at least one blade 21 of the propeller. In other words, the following area relationship should apply: $[A_1 \leq A_2 \leq 1.1*A_1]$. The cross-sectional area ($A_1$) taken in the region of the rear edge 29 of the at least one blade 21 of the propeller is, for instance, greater than 0.04 $m^2$ and less than 0.11 $m^2$.

According to a preferred embodiment of the present invention, the cross-sectional area ($A_3$) of said channel 27, in the region of the outlet opening 11 of the pump housing 6, should be larger than or equal to the cross-sectional area ($A_2$) of the channel 27 in the region of the rear edge 30 of said at least one guide vane 13, and furthermore, the cross-sectional area ($A_3$) of said channel 27, in the region of the outlet opening 11 of the pump housing 6, should be less than or equal to a factor of 1.9 times the cross-sectional area ($A_1$) of said channel 27 in the region of the rear edge 29 of the at least one blade 21 of the propeller. In other words, the following area relationship should preferably apply: $[A_2 \leq A_3 \leq 1.9*A_1]$.

According to a still more preferred embodiment of the present invention, the cross-sectional area ($A_3$) of said channel 27, in the region of the outlet opening 11 of the pump housing 6, should be greater than a factor of 1.2 times the cross-sectional area ($A_2$) of said channel 27 in the region of the rear edge 30 of said at least one guide vane 13, and furthermore, the cross-sectional area ($A_3$) of said channel 27, in the region of the outlet opening 11 of the pump housing 6, should be less than a factor of 1.6 times the cross-sectional area ($A_1$) of said channel 27 in the region of the rear edge 29 of the at least one blade 21 of the propeller. In other words, the following area relationship should preferably apply: $[1.2*A_2 < A_3 < 1.6*A_1]$. Most preferably, the cross-sectional area ($A_3$) of said channel 27, in the region of the outlet opening 11 of the pump housing 6, should be equal to a factor of 1.4 times the cross-sectional area ($A_1$) of said channel 27 in the region of the rear edge 29 of the at least one blade 21 of the propeller.

According to a preferred embodiment of the present invention, the cross-sectional area ($A_2$) of said channel 27, in the region of the rear edge 30 of said at least one guide vane 13, should be greater than a factor of 1.04 times the cross-sectional area ($A_1$) of said channel 27 in the region of the rear edge 29 of the at least one blade 21 of the propeller. Preferably, the cross-sectional area ($A_2$) of said channel 27, in the region of the rear edge 30 of said at least one guide vane 13, should be less than a factor of 1.08 times the cross-sectional area ($A_1$) of said channel 27 in the region of the rear edge 29 of the at least one blade 21 of the propeller. In other words, the following area relationship should preferably apply: $[1.04*A_1 < A_2 < 1.08*A_1]$. Most preferably, the cross-sectional area ($A_2$) of said channel 27, in the region of the rear edge 30 of said at least one guide vane 13, should be equal to a factor of 1.06 times the cross-sectional area ($A_1$) of said channel 27 in the region of the rear edge 29 of the at least one blade 21 of the propeller.

According to the preferred embodiment of the present invention shown in FIG. 2, a wire 31 is connected with a lifting handle 32, which in turn is connected with the pump top 26. Via the inside of the column pipe 2, the wire 31 is running up to a fixing point situated above the column pipe 2; preferably, the extension of the wire 31 coincides with an extension of the centre line of the propeller pump 1. Furthermore, the at least one power supply cable 5 of the propeller pump 1 leaves the pump top 26 and is then attached to the wire 31 and is running abuttingly against the wire 31 up to a level above the column pipe 2. The object of attaching the power supply cable 5 to the wire 31 is that a free-hanging power supply cable will be influenced by a possible, rotary component of velocity in the liquid flow in the column pipe 2, and thereby risk being turned around and worn into pieces against the inner surface of the column pipe 2.

The object of said at least one guide vane 13 is to transform/divert the rotary component of velocity in the liquid flow that is generated by the propeller during operation into a static pressure, or a pressure head, of the pumped liquid.

Feasible Modifications of the Invention

The invention is not limited only to the embodiments described above and shown in the drawings, which only have the purpose of illustrating and exemplifying. This patent application is intended to cover all adaptations and variants of the preferred embodiments described herein, and consequently the present invention is defined by the wording of the accompanying claims and the equipment may accordingly be modified in all feasible ways within the scope of the accompanying claims.

It should be pointed out that the term "cross-sectional area", which has been used in the claims as well as in the description, intends that measurement of the area should be effected transversely/perpendicular to a centre line of the channel, as a consequence of the inner limiting surface of the channel and the outer limiting surface of the channel not being parallel to each other along the length of the entire channel.

The invention claimed is:

1. A propeller pump for the pumping of liquid, comprising:

an axially extending tubular pump housing (6) having an inner surface (9) and comprising an inlet opening (10) and an outlet opening (11), an axially extending pump core (12) having an envelope surface, at least an axial part section of the pump care (12) being surrounded by said pump housing (6), and at least one radially extending guide vane (13), which is connected to the inner surface (9) of the pump housing (6) and to the envelope surface of the pump core (12), the pump core (6) comprising a drive unit (14) and a hydraulic unit (19) that is situated upstream in relation to the drive unit (14) and that comprises a propeller having a hub (20) and at least one blade (21), furthermore the propeller pump (1) comprises an axially extending channel (27) that extends from the inlet opening (10) of the pump housing (6) to the outlet opening (11) of the pump housing (6), which channel (27), in the radial direction, is delimited by the inner surface (9) of the pump housing (6) and the envelope surface of the pump core (12), respectively, wherein a cross-sectional area (A2) of said channel (27), in the region of a rear ethic (30) of said at least one guide vane (13), is greater than a factor of 1.04 times a cross-sectional area (A1) of the channel (27) in the region of a rear edge (29) of the at least one blade (21) of the propeller, the cross-sectional area (A2) of said channel (27), in the region of the rear edge (30) of said at least one guide vane (13), is less than or equal to a factor of 1.1 times the cross-sectional area (A1) of said channel (27) in the region of the rear edge (29) of the at least one blade (21) of the propeller, a cross-sectional area (A3) of said channel (27), in the region of the outlet opening (11) of the pump housing (6), is larger than or equal to the cross-sectional area (A2) of the channel (27) in the region of the rear edge (30) of said least one guide vane (13), the cross-sectional area (A3) of said channel (27), in the region of the outlet opening (11) of the pump housing (6), is less than or equal to a factor of 1.9 times the cross-sectional area (A1) of said channel (27) in the region of the rear edge (29) of the at least one blade (21) of the propeller, and the propeller pump (1) has at specific rotational speed (nq) that is greater than or equal to 200 and that is less than or equal to 300.

2. The propeller pump according to claim 1, wherein the cross-sectional area (A3) of said channel (27), in the region of the outlet opening (11) of the pump housing (6), is greater than a factor of 1.2 times the cross-sectionai area (A2) of said channel (27) in the region of the rear edge (30) of said at least one guide vane (13), and that the cross sectional area (A3) of said channel (27), in the region of the outlet opening (11) of the pump housing (6), is less than a factor of 1.6 times the cross-sectional area (A1) of said channel (27) in the region of the rear edge (29) of the at least one blade (21) of the propeller.

3. The propeller pump according to claim 1 wherein the cross-sectional area (A2) of said channel (27)in the region of the rear edge (30) of said at least one guide vane (13), is less than a factor of 1.08 times the cross-sectional area (A1) of said channel (27) in the region of the rear edge (29) of the at least one blade (21) of the propeller.

4. The propeller pump according to claim 1, wherein the pump core (12) furthermore comprises a sealing unit (22), which in turn comprises an axially extending tubular oil housing (23) and said at least one guide vane (13), which sealing unit (22) is arranged surrounded by said pump housing (6), said at least one guide vane (13) being fixedly connected to an inner surface of the pump housing (6) and to an envelope surface of the oil housing (23).

5. The propeller pump according to claim 4, wherein the drive unit (14) comprises an axially extending tubular motor housing (17) having an envelope surface (18), which drive unit (14) is connected to and arranged downstream the sealing unit (22).

6. The propeller pump according to claim 5, wherein the channel (27) of the pump housing (6), in the radial direction, is delimited by the inner surface of the pump housing (6) and an envelope surface of the hub (20) of the propeller, the envelope surface of the oil housing (23), and the envelope surface (18) of the motor housing (17), respectively.

7. The propeller pump according to claim 4, wherein the hydraulic unit (19) is arranged adjacent to and upstream the sealing unit (22).

8. The propeller pump according to claim 1, wherein the pump core (12) and the pump housing (6) are concentrically arranged.

9. The propeller pump according to claim 1, wherein the channel (27) of the pump housing (6) has a subchannel that, in the axial direction, extends from the part situated farthest upstream of the hub (20) of the propeller to the outlet opening (11) of the pump housing (6), said subchannel having a toroidal shape.

10. The propeller pump according to claim 1, wherein that the propeller comprises three blades (21), and that the propeller pump (1) comprises seven guide vanes (13).

11. A pump station for the pumping of liquid, comprising a propeller pump (1) according to claim 1 and a column pipe (2), the propeller pump (1) being arranged in a lower end of the column pipe (2) concentrically with the same.

* * * * *